United States Patent [19]

Schillinger

[11] 4,354,598

[45] Oct. 19, 1982

[54] ARTICLE DISPLAY PACKAGE AND BLANK THEREFOR

[75] Inventor: Joseph F. Schillinger, Fulton, Ill.

[73] Assignee: Champion International Corporation, Stamford, Conn.

[21] Appl. No.: 295,771

[22] Filed: Aug. 24, 1981

[51] Int. Cl.[3] ..... B65D 73/00

[52] U.S. Cl. ..... 206/462; 206/476

[58] Field of Search ..... 206/461, 462, 463, 476

[56] References Cited

U.S. PATENT DOCUMENTS

| | | | |
|---|---|---|---|
| 1,011,697 | 12/1911 | Witkowski | 206/462 |
| 3,095,966 | 7/1963 | Pfohl | 206/461 |
| 3,179,246 | 4/1965 | Rosenburg | 206/462 |
| 3,246,747 | 4/1966 | Blish | 206/462 |
| 3,985,232 | 10/1976 | Johnson | 206/461 |
| 3,990,578 | 11/1976 | Roeser | 206/461 |
| 4,046,251 | 9/1977 | Bruml | 206/463 |

*Primary Examiner*—William Price
*Assistant Examiner*—Jimmy Foster
*Attorney, Agent, or Firm*—Evelyn M. Sommer

[57] ABSTRACT

This package is particularly adapted for carrying an article to display the latter at the point of sale. The package is formed from a unitary paperboard blank and includes product retaining openings along with integral product encircling portions to retain the product in the openings. The preferred embodiment of the package is adapted for use in carrying flashlights along with batteries carried separately by the package.

16 Claims, 4 Drawing Figures

ARTICLE DISPLAY PACKAGE AND BLANK THEREFOR

This invention relates to a display package for retaining an article so that the article is displayed at the point of sale. In particular, the preferred embodiment of the package of this invention is adapted to hold a flashlight, and, separately, batteries for operating the flashlight.

It is known in the prior art to provide specialized packages for containing articles so as to display the articles at the point of purchase. These packages are typically cards formed from paperboard which may or may not employ blister package components to display the article while retaining it in the card. This invention relates to an improved form of such a package formed from a folded paperboard blank which includes one or more openings for insertion of the packaged articles, and further includes integral paperboard article encircling or embracing portions for retaining the articles in the openings. In the preferred embodiment disclosed herein, the openings in the blank are particularly configured to contain a flashlight, and an additional opening may be provided to cooperate with a blister package to separately secure batteries to the package.

The package of this invention is formed from a paperboard blank having front and back major panels foldably connected together. Each major panel has formed therein an opening, which openings coincide with each other when the blank is folded to the erected condition. The openings are configured to the shape of a flashlight which is inserted into the openings so as to be held, yet displayed, thereby. A retaining panel is foldably connected to one of the major panels so that when the blank is folded, both ends of the retaining panel will be sandwiched between the major panels and the mid portion will extend through one of the openings to bridge the latter so as to embrace a portion of the handle of the flashlight thereby preventing accidental removal of the flashlight from the openings. Auxiliary openings may also be provided to cooperate with a blister package to separately hold batteries for the flashlight.

It is, therefore, an object of this invention to provide a package for retaining an article while displaying the latter at the point of purchase.

It is a further object of this invention to provide a package of the character described which is formed from a folded paperboard blank having article receiving openings formed therein, and having integral retention panels for engaging the articles which are disposed in the article receiving openings.

It is yet another object of this invention to provide a package of the character described which is particularly adapted for retaining flashlights.

These and other objects and advantages of the package of this invention will become more readily apparent from the following detailed description of a preferred embodiment thereof taken in conjunction with the accompanying drawings, in which.

Figure 1:
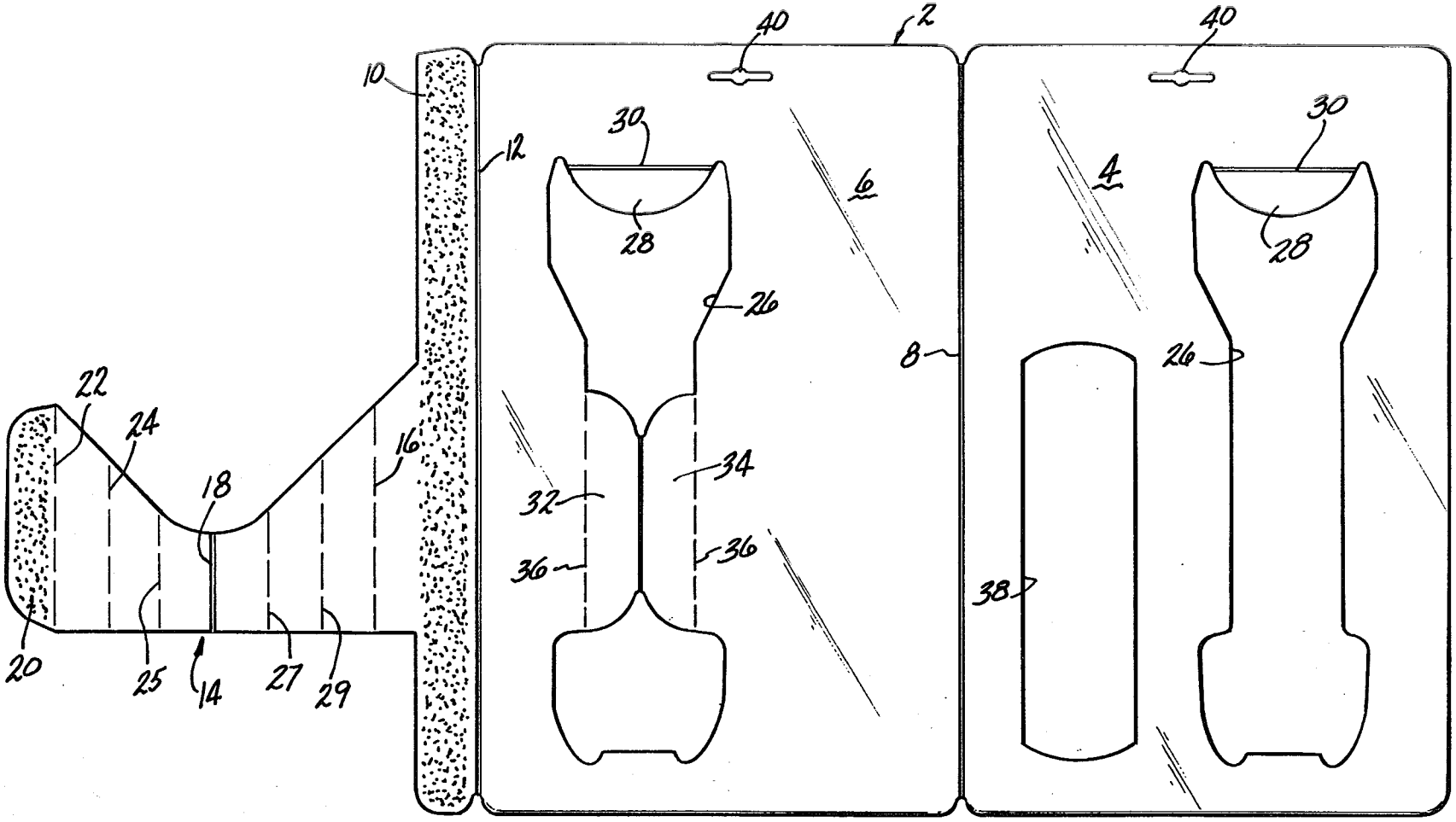
FIG. 1 is a plan view of a paperboard blank from which a preferred embodiment of the package of this invention is formed.

Referring now to the drawings, there is shown in FIG. 1 a preferred embodiment of a paperboard blank formed in accordance with this invention, from which the package of this invention is erected. The blank, denoted generally by the numeral 2, includes two major panels, a front panel 4 and a back panel 6 which are connected to each other by means of a fold line 8. A tuck flap 10 is connected to the back panel 6 by means of a fold line 12. The tuck flap 10 is provided with an elongated article retention panel 14 which is connected to the tuck flap 10 by means of a fold line 16. The retention panel 14 is provided with a medial fold line 18 and terminates in a glue flap 20 connected to the retention panel 14 by means of a fold line 22. Intermediate score lines 24, 25, 27 and 29 are provided in the retention panel 14 so that the latter can assume the general rounded contour of a flashlight held in the package, and can be easily preassembled into a flattened form and transformed from the flattened to an expanded form, as will be explained more fully hereinafter.

The front and back panels 4 and 6 are each provided with openings 26 which are contoured to the shape of the particular type of flashlight to be held in the package. Curved flaps 28 extend down into the upper end of the openings 26 from fold lines 30, the flaps 28 serving to engage the lens housing well of the flashlight disposed in the openings 26. The opening 26 in the back panel 6 is provided with secondary retention flaps 32 and 34 which are connected to the back panel by means of fold lines 36. The front panel 4 is provided with an elongated opening 38 for retaining a blister pack of batteries for use with the flashlight. Hanger openings 40 are disposed in the front and back panels 4 and 6 so that the package may be displayed on a conventional wire rack at the point of purchase.

Figure 2:
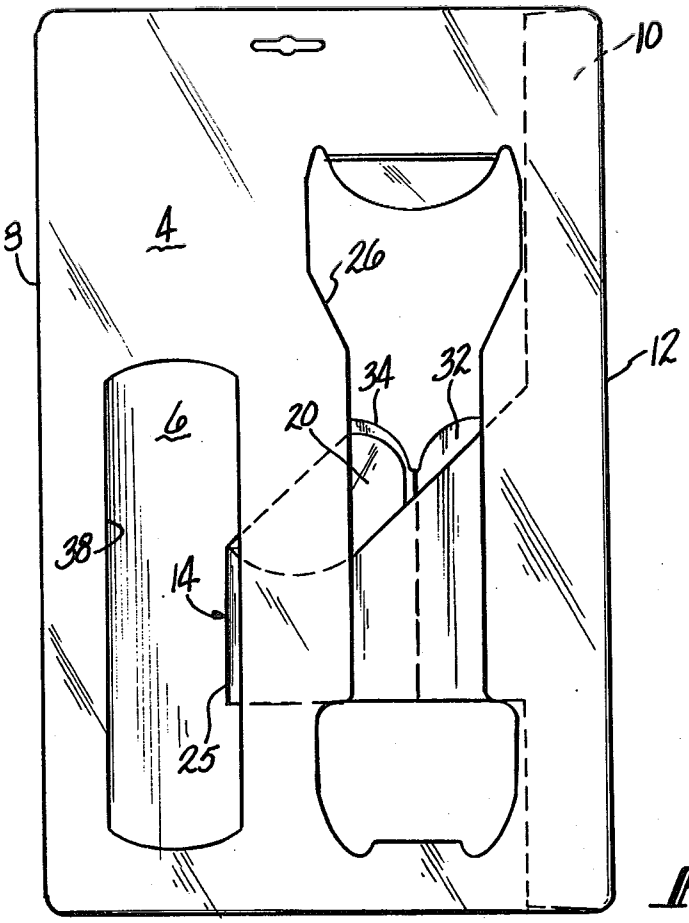
FIG. 2 is a front elevational view of a flattened form of the package suitable for shipping in bulk, which flattened form is produced by folding and gluing the blank of FIG. 1.

To assemble the blank 2 to the bulk shipping flattened form shown in FIG. 2, glue is applied to the tuck and glue flaps 10 and 20 respectively, as shown by the stippling in FIG. 1. The retention panel 14 is then folded back along score line 25 and the tuck flap 10 is folded back along fold line 12 whereby the glue flap 20 will come into contact with and be secured to the secondary retention flap 34, it being understood that the glue flap 20 will be secured to the reverse side of the secondary retention flap 34, as viewed in FIG. 1. The front panel 4 is then folded back along the fold line 8 until the front panel 4 comes into contact with and is adhesively secured to the tuck flap 10. The result is the flattened package form shown in FIG. 2 which form is particularly suited for bulk shipment from the point of manufacture to the point wherein the flashlight and batteries will be placed in the package. It will be noted that the tuck flap 10 is secured to the reverse side of the front panel 4, and the glue flap 20 is secured to the secondary retention flap 34. The retention panel 14 is sandwiched between the adjacent front and rear panels 4 and 6 respectively, the retention panel 14 being flattened by reason of the folded score line 25. The openings 26 are in registry, and the opening 38 is closed in the back by the back panel 6. The front and back panels 4 and 6 respectively are secured together only at their lateral edges by the fold line 8 on one side, and by the tuck flap 10 and its fold line 12 on the other side. The medial portions of the front and back panels 4 and 6 respectively can be pulled apart to some degree by reason of the flexibility of the paperboard.

Figure 3:
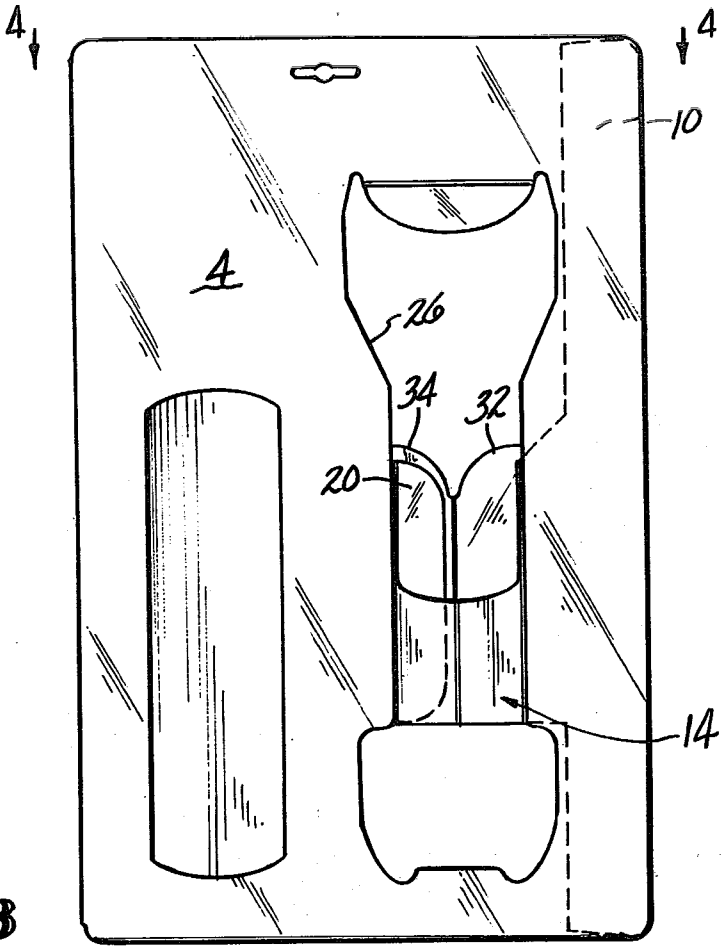
FIG. 3 is a front elevational view of the package which is formed after expanding the flattened package shown in FIG. 1.
Figure 4:
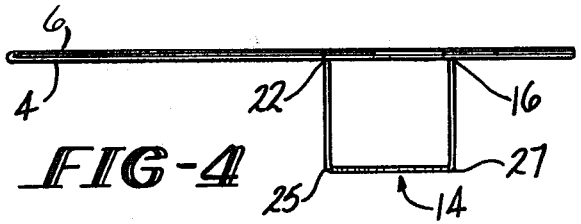
FIG. 4 is an end view of the package taken along line 4—4 of FIG. 3.

The package is transformed from the flattened form shown in FIG. 2 to the expanded form shown in FIGS. 3 and 4 by grasping the edges of the openings 26 and pulling the medial portions of the front and back panels 4 and 6 respectively away from each other to free the retention panel 14 which is then pulled out through the opening 26 in the front panel 4 so as to project through the opening 26 in the front panel 4 as shown in FIGS. 3 and 4. The fold lines 22 and 16 and the score lines 25 and 27 permit the retention panel 14 to project forward from the front panel 4 and to bridge the opening 26. The secondary retention flaps 32 and 34 bridge the opening 26 in the back panel 6. The use of the projecting bridging retention panel 14 enables the relatively flat package to contain bulky articles, such as flashlights, without the need of any additional securement of the article to the package. The batteries will be packaged in a conventional blister pack which is secured to the back panel 6 and projects through the opening 38.

While the preferred embodiment of the package is particularly adapted for holding flashlights, it will be readily appreciated that the principles of the invention can be applied equally well to packages adapted to hold articles other than flashlights. The package of this invention provides for positive retention of relatively bulky articles despite the package itself being relatively flat. The package can be made from a unitary blank which can be folded and glued to form a flattened form of the package which is particularly suited for bulk shipment of the packages from the point of manufacture to the point of use. The flattened forms can be readily expanded to a form ready for reception of the articles to be packaged, the expansion being manually or mechanically performable.

Since many changes and variations of the disclosed embodiment of the invention may be made without departing from the inventive concept, it is not intended to limit the invention otherwise than as required by the appended claims.

What is claimed is:

1. An article display package comprising:

(a) a paperboard front panel;

(b) a paperboard back panel foldably connected to one edge of said front panel, said back panel being juxtaposed in face to face relationship with said front panel;

(c) a tuck flap foldably secured to one of said front and back panels, said tuck flap being sandwiched between said front and back panels and adhesively secured to the other of said front and back panels whereby opposite edges of said front and back panels are secured together;

(d) means forming an article receiving opening in said front and back panels, said article receiving opening being configured substantially to the shape of the article to be received therein; and (e) uninterrupted paperboard retention panel extending from an edge of said tuck flap between said front and back panels to a first edge of said article receiving opening, said retention panel having a first portion extending from said first edge of said opening outwardly from said front and back panels, a second portion secured to one of said front and back panels and extending from the opposite edge of said opening outwardly from said front and back panels, and a third medial portion foldably connected to said first and second portions and extending therebetween whereby said retention panel bridges one side of said opening to embrace only a portion of a relatively bulky article positioned in said opening to retain the article in said opening while permitting the remainder of the article to be displayed.

2. The package of claim 1, further comprising at least one retention flap foldably connected to said back panel and at least partially bridging the other side of said opening to aid in retaining the article in said opening.

3. The package of claim 2, wherein said second portion of said retention panel is adhesively secured to said retention flap.

4. The package is claim 1, wherein said retention panel is foldably connected to said edge of said tuck flap.

5. The package of claim 2, wherein said opening has the general configuration of a flashlight, and further comprising flap means at one end of said opening to engage the lens housing of a flashlight disposed in said opening to aid in retaining the flashlight in said opening.

6. An article display package comprising:

(a) paperboard front and back panels having opposite edges secured together to form a composite article supporting member;

(b) means forming an article supporting opening in said front and back panels, said opening being configured generally to the shape of the article to be supported therein;

(c) a paperboard retention panel having opposite ends thereof secured to said article supporting member, said retention panel bridging said opening on one side of said article supporting member and having a medial portion spaced outwardly from said article supporting member to embrace one side of a relatively bulky article disposed in said opening to retain the article in said opening; and (d) flap means bridging at least a major portion of said opening on the other side of said article supporting member to embrace the other side of the article disposed in said opening.

7. The package of claim 5 wherein said retention panel is dimensionally restricted so as to allow visual display of a major portion of the article disposed in said opening.

8. An article display package comprising:

(a) paperboard front and back panels having opposite edges secured together to form a composite article supporting member, the medial portions of said front and back panels being free of securement with each other;

(b) means forming an article supporting opening in said front and back panels, said opening being configured generally to the shape of the article to be supported therein; and (c) a paperboard retention panel having opposite ends thereof secured to said article supporting member at opposite sides of said opening, said retention panel being provided with a plurality of traversing fold lines whereby said retention panel can be collapsed to a flattened condition wherein a medial portion of said retention panel is sandwiched between said front and back panels adjacent to said opening, said fold lines further enabling said medial portion of said retention panel to be withdrawn from between said front and back panels and shifted to an article embracing position outwardly offset from said front and back panels to embrace the side of a relatively bulky article positioned in said opening to aid in retaining the article in said opening.

9. The package of claim 8, further comprising at least one retention flap at least partially bridging a side of said opening opposite said retention panel to aid in retaining an article positioned in said opening.

10. The package of claim 9, wherein one end of said retention panel is adhesively secured to said retention flap.

11. The package of claim 10, wherein the other end of said retention panel is foldably secured to an edge of said composite article supporting member and sandwiched between said front and back panels.

12. The package of claim 11, wherein said opening is configured in the general form of a flashlight.

13. The package of claim 12, further comprising flap means at one end of said opening operable to engage the lens housing of a flashlight positioned in said opening to aid in retaining the flashlight in said opening.

14. A paperboard blank for forming an article display package, said blank comprising:

(a) a front panel;

(b) a back panel;

(c) a first fold line interconnecting adjacent edges of said front and back panels;

(d) article supporting openings formed in said front and back panels, said openings being configured to the general shape of the article to be positioned therein, and said openings being spaced apart so as to be in registry with each other when said back panel is folded about said first fold line into juxtaposition with said front panel;

(e) a retention panel adjacent to an edge of one of said front and back panels which edge is opposite said first fold line;

(f) first means foldably connecting said retention panel to said one of said front and back panels; and (g) said retention panel having a plurality of parallel fold lines wherein said retention panel can be folded to project through said article supporting opening in said front panel.

15. The blank of claim 14, wherein said first means is a tuck flap adapted to be secured to the other of said front and back panels.

16. The blank of claim 14, further comprising at least one retention flap foldably connected to said back panel to at least partially span said opening in said back panel.

* * * * *